US006557472B2

(12) United States Patent
Detmers et al.

(10) Patent No.: US 6,557,472 B2
(45) Date of Patent: May 6, 2003

(54) APPARATUS FOR GUIDING A PRINT CARRIER AND PRINTING UNIT IN A ROTARY PRINTING MACHINE HAVING THE APPARATUS

(75) Inventors: Andreas Detmers, Heddesheim (DE); Rene Güldenberg, Jülich (DE); Arno Jünger, Nussloch (DE); Jürgen Kreutzkämper, Sinsheim-Hoffenheim (DE); Sven Mader, Dielheim (DE); Christian Meier, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/859,833

(22) Filed: May 17, 2001

(65) Prior Publication Data

US 2001/0042461 A1 Nov. 22, 2001

(30) Foreign Application Priority Data

May 17, 2000 (DE) ..... 100 23 726

(51) Int. Cl.[7] ..... B41L 47/14
(52) U.S. Cl. ..... 101/477; 101/420
(58) Field of Search ..... 101/477, 416.1, 101/420, 216, 479

(56) References Cited

U.S. PATENT DOCUMENTS 3,261,288 A * 7/1966 Dickerson ..... 101/416.1
3,442,506 A * 5/1969 Pasquinelli ..... 101/416.1
3,602,140 A * 8/1971 Sudduth ..... 101/416.1
4,917,013 A * 4/1990 Katz ..... 101/375
5,738,015 A * 4/1998 Kusch et al. ..... 101/477
5,862,755 A * 1/1999 Haupenthal ..... 101/246
5,964,148 A * 10/1999 Ishii ..... 101/116

FOREIGN PATENT DOCUMENTS

DE 44 14 443 C1 11/1995
DE 44 40 239 C2 5/1996

* cited by examiner

*Primary Examiner*—Anh T. N. Vo
*Assistant Examiner*—Blaise Mouttet
(74) *Attorney, Agent, or Firm*—Laurence A. Greenberg; Werner H. Stemer; Ralph E. Locher

(57) ABSTRACT

An apparatus is provided for guiding a print carrier upon feeding the print carrier to and guiding the print carrier away from a form cylinder of a rotary printing machine. Guide elements for the print carrier are disposed axially parallel to the form cylinder. The guide elements are disposed in two groups. One group serves to pull the print carrier into the printing unit, while the other group assists in the removal of the print carrier from the printing unit of the rotary printing machine. The guide elements assisting the feeding-in and exchanging of the print carrier are protected against contact with the print carrier by throw-on elements during exchange of a print carrier. A printing unit in a rotary printing machine having the apparatus is also provided.

3 Claims, 3 Drawing Sheets

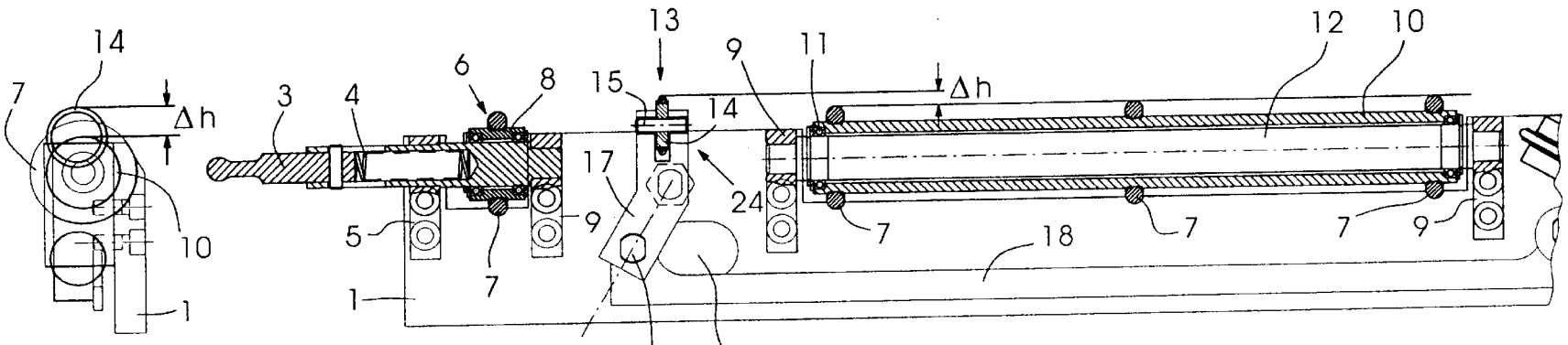
Fig.1.1
Fig.1.3
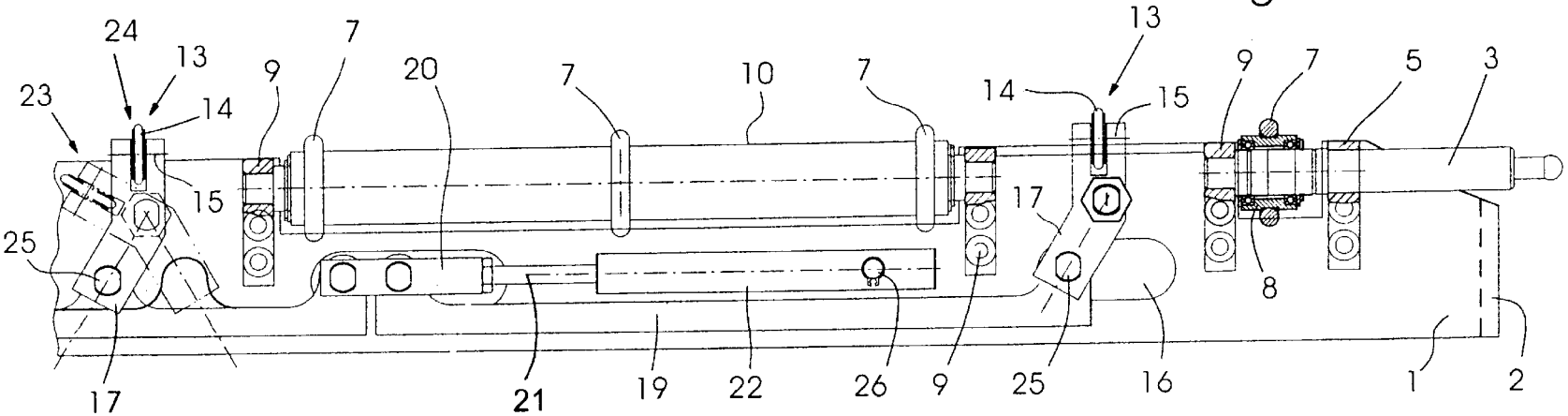
Fig.1.2

APPARATUS FOR GUIDING A PRINT CARRIER AND PRINTING UNIT IN A ROTARY PRINTING MACHINE HAVING THE APPARATUS

BACKGROUND OF THE INVENTION

FIELD OF THE INVENTION

The invention relates to an apparatus for guiding a print carrier, as well as a printing unit in a rotary printing machine having the apparatus. Throw-on and throw-off guide elements and guiding elements which can be adjusted relative to the former are provided for exchanging a print carrier, especially a printing plate or printing film, that is detachably held on a cylinder of a rotary printing machine.

German Patent DE 44 14 443 C1 has disclosed an apparatus for guiding a print carrier. A print carrier is guided to or away from a plate cylinder of a rotary printing machine with that apparatus. For that purpose, guide elements are disposed axially parallel to the plate cylinder and can be positioned through the use of an actuating mechanism. Two groups of guide elements are provided. In each case, one group is used as guide rollers for inserting the plate in order to feed-in the print carrier at a defined distance from the surface of the plate cylinder. The other group is thrown-off as a guide roller for plate ejection.

The respective guide roller for the plate ejection can be set at a defined distance from the surface of the plate cylinder in order to guide the print carrier out. The guide roller is thrown off for the plate insertion.

When unloading a used printing form provided with ink, be it a printing plate or a printing film, rings of the pressure roll are soiled by ink from the printing plate. When a new printing plate is clamped in, that ink is transferred to the unimaged printing plate by the ink-smeared rings. Due to the ink soiling, it is possible for imaging faults, disruptions or changes during the imaging of the printing plate to occur in directly imaging rotary printing machines. That problem is inherent in all directly imaging rotary printing machines with exchangeable printing plates.

Printing problems can likewise occur in machines with CTP and process-less printing plates or printing films. Those problems occur if ink from the rollers gets onto the printing plate, when the plate or the film is being fed in. The ink has a detrimental influence on the imaging behavior of the respectively soiled zones during the imaging, for example through the use of a laser head, as compared with unsoiled zones.

SUMMARY OF THE INVENTION

It is accordingly an object of the invention to provide an apparatus for guiding a print carrier and a printing unit in a rotary printing machine having the apparatus, which overcome the hereinafore-mentioned disadvantages of the heretofore-known devices of this general type and which avoid imaging faults in directly imaging rotary printing machines resulting from changing a print carrier.

With the foregoing and other objects in view there is provided, in accordance with the invention, in a rotary printing machine having a printing unit with a form cylinder, an apparatus for guiding a print carrier when feeding the print carrier to and guiding the print carrier away from the form cylinder. The apparatus comprises guide elements axially parallel to the form cylinder for assisting in feeding-in and pressing-on the print carrier. The guide elements are disposed in two groups. One of the groups of guide elements serves to pull-in the print carrier and the other of the groups of guide elements serves to remove the print carrier from the printing unit. Throw-on elements keep the guide elements from making contact with the print carrier during exchanging of the print carrier.

The advantages of the apparatus according to the invention can primarily be seen in the fact that when removing the respective print carrier, be it a printing plate or a printing film, contact between the inked print-carrier surface and the respective new print carrier, either printing plate or printing film, is prevented. Therefore, imaging faults resulting from handling can be ruled out in directly imaging rotary printing machines. The guide elements for the new print carrier to be fed in are effectively protected against any transfer of soiling from the preceding removal operation of the preceding printing form from the printing unit of the rotary printing machine. This is accomplished by constructing the throw-on elements as rotationally symmetrical bodies which can be pivoted or moved or which have a size that can be changed, in each case contacting the surfaces of the print carrier to be exchanged.

In accordance with another feature of the invention, the throw-on elements can be varied in terms of their position, their shape and their size in relation to the respective guide elements for a new print carrier to be fed in, be it a printing plate or printing film. The throw-on elements can be constructed to be pivotable in relation to the guide elements, they can be movable or their size relative to the latter can be changed. In particular, a contact zone between peripheral surfaces of the throw-on elements and the printing form to be guided away may be defined exactly, by changing the size in the circumferential direction. In that way, guide elements having a small diameter or being placed in a lower plane are effectively protected against any contact with the soiled surface of the printing form to be guided away.

In accordance with a further feature of the invention, the throw-on elements which have a soiled surface from the preceding operations are moved out of an active range of the guide elements contacting the fresh and printed printing form both before and during the action of feeding in a fresh printing form for imaging in the rotating system. For this purpose, the throw-on elements can either be pivoted away from the contact plane of the guide elements with the surface of the printing form to be fed in, can be moved away or removed from a range of engagement of the guide elements with the print-carrier surface through the use of a change in size.

In accordance with an added feature of the invention, a relative position between the peripheral surfaces of the guide elements and those of the throw-on elements can be changed by an actuating travel $\Delta h$ through the use of an actuating cylinder. In this case, the actuating travel $\Delta h$ can be preselected in such a way that when the throw-on elements make contact with the surface of the print carrier, the guide elements are located at a sufficient safety margin with respect to soiling from the soiled print-carrier surface.

In accordance with an additional feature of the invention, the movable throw-on elements may be connected to one another in an articulated manner through the use of coupling elements and coupling rods, for example on a base plate which rotatably accommodates the guide elements for the new printing form. In this case, the movable throw-on elements which can be actuated in this way are spaced apart from one another, through the use of an actuating cylinder to which a pressure medium can be applied. This is done in such a way that the throw-on elements support the printing plate to be removed from the printing unit of the rotary printing machine uniformly over the width of the printing unit. This results in no regions hanging down in the extent of the width of the print medium to be removed from the printing unit. Such regions could touch guide elements positioned underneath and, in that way, an undesired transfer of ink could take place. The throw-on elements, which are connected to one another in an articulated manner by the coupling elements and coupling rods, may be moved from an extended position into a retracted position and vice versa by applying pressure to the actuating cylinder.

In accordance with yet another feature of the invention, in the extended printing position of the throw-on elements, their peripheral surfaces project by an amount Δh beyond the peripheral surfaces of the guide elements. In addition to extending or pivoting the throw-on elements in relation to guide elements which are disposed in a stationary position for a print carrier to be fed in, throw-on surfaces to which pressure medium can be applied can be accommodated on a carrier that accommodates stationary guide elements. The throw-on elements to which pressure medium is applied can be connected directly to a cavity containing pressure medium through an opening and can be acted on directly through that cavity. It is equally possible to bring the throw-on elements into a position having a diameter that exceeds the peripheral surface of the carrier accommodating them, through contact surfaces constructed as a throw-on element, by using a plunger to which pressure medium can be applied.

In accordance with yet a further feature of the invention, a form cylinder, which accommodates a print carrier in the form of a printing plate or a printing film, can be associated with a carrier wheel having a circumferential position that can be influenced and a periphery which accommodates a group of guide elements in one segment and a group of throw-on elements in a further segment.

In accordance with yet an added feature of the invention, a guide element is accommodated in an articulated manner between two fixed bearings and is to be thrown onto the peripheral surface of the plate cylinder by an actuating cylinder to which a pressure medium can be applied. In this structural variant, the throw-on element remains in a fixed position, since it is associated with a fixed bearing. However, through the use of the actuating cylinder, which in turn is accommodated on a fixed bearing, the guide element can be thrown onto the peripheral surface of the form cylinder of a printing unit of a rotary printing machine.

With the objects of the invention in view, there is also provided, in a rotary printing machine, a printing unit, comprising a form cylinder, and an apparatus for guiding a print carrier when feeding the print carrier to and guiding the print carrier away from the form cylinder. The apparatus has guide elements disposed axially parallel to the form cylinder for assisting in feeding-in and pressing-on the print carrier. The guide elements are disposed in two groups. One of the groups of guide elements serves to pull-in the print carrier and the other of the groups of guide elements serves to remove the print carrier from the printing unit. The apparatus has throw-on elements for keeping the guide elements from making contact with the print carrier during exchanging of the print carrier.

The apparatus according to the invention may be provided on a printing unit of a directly imaging rotary printing machine, with laser-head units directly imaging the printing forms being provided in the printing units of such rotary printing machines. These units image the print carriers on the basis of imaging information stored in an RIP. The higher the surface quality of the printing forms to be fed in, the more accurate imaging may be achieved in the directly imaging rotary printing machine.

Other features which are considered as characteristic for the invention are set forth in the appended claims.

Although the invention is illustrated and described herein as, embodied in an apparatus for guiding a print carrier, as well as a printing unit in a rotary printing machine having the apparatus, it is nevertheless not intended to be limited to the details shown.

Various modifications and structural changes may be made in the invention without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 1.1 is a fragmentary, diagrammatic, partly-sectional view of a first section of a base plate, on which two guide elements are mounted so as to be stationary and throw-on elements that can be moved relative to the latter are provided;

FIG. 1.2 is a fragmentary, partly-sectional view of a second section of the base plate according to FIG. 1 with a safeguard fitted at a side;

FIG. 1.3 is a side-elevational view of the base plate with a stationary guide and extended throw-on elements;

DESCRIPTION OF THE PREFERRED EMBODIMENTS

Figure 2:
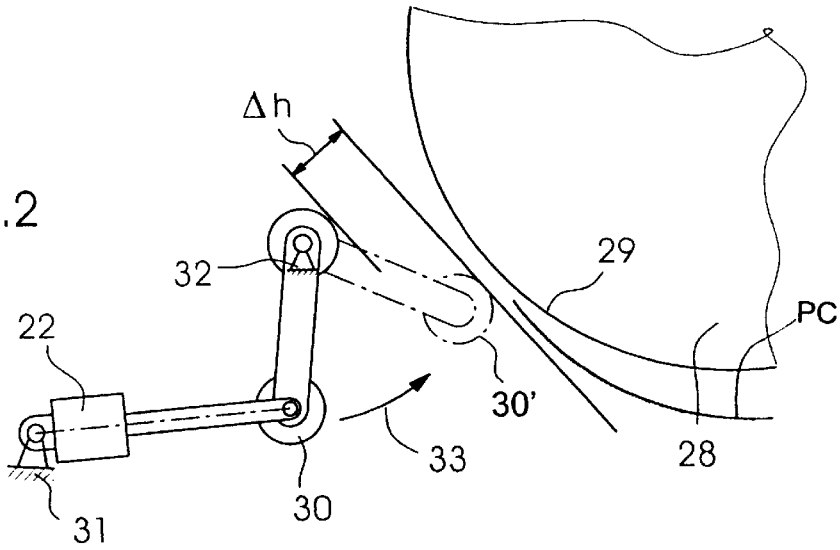
FIG. 2 is a fragmentary, elevational view of a further structural variant of guide or guiding elements for print carriers thrown onto a circumferential cylinder surface.

Referring now to the figures of the drawings in detail and first, particularly, to FIG. 1 thereof, there is seen a first section of a base plate, on which two guide elements that are mounted so as to be stationary, and throw-on elements which can be moved relative to the latter, are provided.

Spring pins 3 are accommodated at sides of a base plate 1, which extends substantially over the width of a printing unit. The base plate 1 can be mounted in non-illustrated side walls, of the printing unit of a directly imaging rotary printing machine through the use of the spring pins 3. The base plate 1 is secured at one end by a groove (seen in FIG. 1.2) in the side wall of the directly imaging rotary printing machine. The spring pin 3 which is provided at the side of one or both ends of the base plate is prestressed by a spring 4 provided in a sleeve and is mounted on the base plate 1 through the use of a pin bearing element 5.

The respective spring pins 3 in the side regions of the base plate 1 are adjoined directly by guide elements 6 and 7 accommodated on its round body. The guide elements include a ring 7 of resilient material that is fitted on a sleeve-like carrier body which, in turn, is mounted in bearings, and is disposed in such a way that it can rotate by circulating on an outer peripheral surface of the spring pin 3. A pin body of the spring pin 3 is enclosed and fixed on the base plate 1 on one side by the pin bearing element 5 and on the other side by a mounting 9. A tubular carrier body 10, which is also mounted on the base plate 1, has end sections that are likewise fitted in the mountings 9 on the base plate. The tubular carrier body 10 has an outer peripheral surface which contains three annular guide elements that are spaced apart uniformly from one another. The tubular carrier body 10 is rotatably fitted to a shaft through the use of a mounting 11. A movable throw-on element 13 is disposed between the guide elements 6, 7, which serve to feed a print carrier to be newly fed to the printing unit. The movable throw-on element can be constructed, for example, as a rotationally symmetrical body 14, which is accommodated in a coupling element 17 in such a way that it can rotate about an axis of rotation 15. The coupling element 17 is connected at a lower attachment point 25 to a first coupling rod 18, which extends parallel to the tubular carrier body 10 of the base plate 1. The attachment point 25 which is formed, for example, as a secured screw connection, moves in an opening 16 in the base plate 1 which, for example, can be constructed like a slot. In the configuration illustrated in FIG. 1.1, the throw-on element 13 is in its extended position 24, in which an outer periphery of the body of rotation 14 projects beyond an outer periphery of the annular guide elements 7 by a distance Δh.

According to the illustration in FIG. 1.2, which shows a second section of the base plate according to FIG. 1 with a safeguard or protective device fitted at the side, the throw-on element 13 located in its extended position 24 can also be moved into a retracted position 23. In FIG. 1.2, the extended position 24 of the throw-on element 13 is illustrated by thicker lines than the retracted position 23 of the throw-on element, which is illustrated by an oblique representation of the body of rotation 14 mounted in the coupling element 17.

The first coupling rod 18 according to FIG. 1.1 is accommodated on a coupler 20, on which a second coupling rod 19 is provided. The second coupling rod 19 is connected to a pivotable throw-on element 13 provided at the other end of the base plate 1. The throw-on element 13 provided at this end is also provided with a coupling element 17. In the illustration according to FIG. 1.2, the throw-on element 13 is shown in its extended position 24. In this position, the outer periphery of the body of rotation 14 projects beyond the outer periphery of the guide element 7 by an amount Δh in an analogous way to the structure shown in FIG. 1.1. The first coupling rod 18 and the second coupling rod 19, which are together fitted to the coupler 20, are moved through the use of a coupling rod 21 which, in turn, can be moved in the horizontal direction by an energy storage device in the form of an actuating cylinder 22. The actuating cylinder 22 is fitted to an actuating-cylinder abutment 26 on the base plate 1 and actuates the three movable throw-on elements on the base plate 1, according to the illustration in FIGS. 1.1 and 1.2, from the extended position 24 into the retracted position 23.

It can also be seen that a spring-loaded pin 3 or a rigid pin, which is accommodated in a pin bearing element 5 and in a mounting 9, are disposed at the end of the base plate 1 illustrated in FIG. 1.2. Analogous to the illustration of FIG. 1.1, a sleeve-like carrier 8 is disposed on the peripheral surface of the pin body, between the pin bearing element 5 and the mounting 9. The sleeve-like carrier 8 has a peripheral surface on which an annular guide element 7 of resilient material is mounted. The sleeve-like carrier 8 is fitted on the peripheral surface of the pin body of the spring pin 3 or of a rigid pin, through the use of ball bearings so that it can be rotated easily. In addition, the illustration of FIG. 1.2 reveals a guide groove 2, with which the base plate can be guided in a non-illustrated side wall of a printing unit of a rotary printing machine, in addition to being locked by the two aforementioned spring pins 3.

During unclamping of a print carrier located in the printing unit of a directly imaging rotary printing machine, the throw-on elements 13 are moved from their retracted positions 23 into their respectively extended position 24 by actuating the actuating cylinder 22. In addition, since the peripheries of the bodies of rotation 14 project beyond those of the guide elements 7 by the distance Δh, the throw-on elements 13 protect the guide elements 7 against soiling by the soiled surface of the print carrier to be removed. Once the print carrier has been unclamped from the printing unit, the throw-on elements 13 can be moved back again into the retracted position 23 according to FIG. 1.2, for example by a spring restoring device on an actuating cylinder 12, and can leave the active range to the guide elements 6 and 7 which are accommodated so as to be stationary on the base plate 1.

The illustration according to FIG. 1.3 reveals a side view of the base plate 1, which shows the effective height difference between the peripheral surfaces of the bodies of rotation 14 of the throw-on elements 13 and the resilient, annular guide elements 7 that are mounted so as to be stationary on the base plate.

FIG. 2 shows a further structural variant of the concept according to the invention, with a guide element for print carriers which is mounted in such a way that it can be thrown onto and off a peripheral cylinder surface of a form cylinder.

In this structural variant, two fixed bearings 31 and 32 are provided. A body of rotation which can be rotated but is accommodated in a stationary position is mounted on the fixed bearing 32. A diagrammatically illustrated actuating cylinder 22 which can be acted upon is shown on the fixed bearing 31. In this configuration, a guide element 30 which can be thrown onto a peripheral surface 29 of a form cylinder 28 is shown between the two fixed bearings 31 and 32. When the actuating cylinder 22 is activated, the guide element 30 moves up toward the peripheral surface 29 of the form cylinder 28, into its position designated by reference numeral 30'. In this state, the peripheral surface of the guide element, in position 30', comes out beyond the peripheral surface of the body of rotation on the fixed bearing 32, which is fitted in a stationary position, by the amount Δh. It is possible for the pressing movement of a print carrier PC against the peripheral surface 29 of the form cylinder 28 to be assisted by the thrown-on guide element 30. In this structural variant, the body of rotation 32 remains at rest, as opposed to the movable throw-on elements according to FIG. 1, which are adjusted relative to the guide elements 6, 7 that are fitted so as to be stationary.

Figure 3:
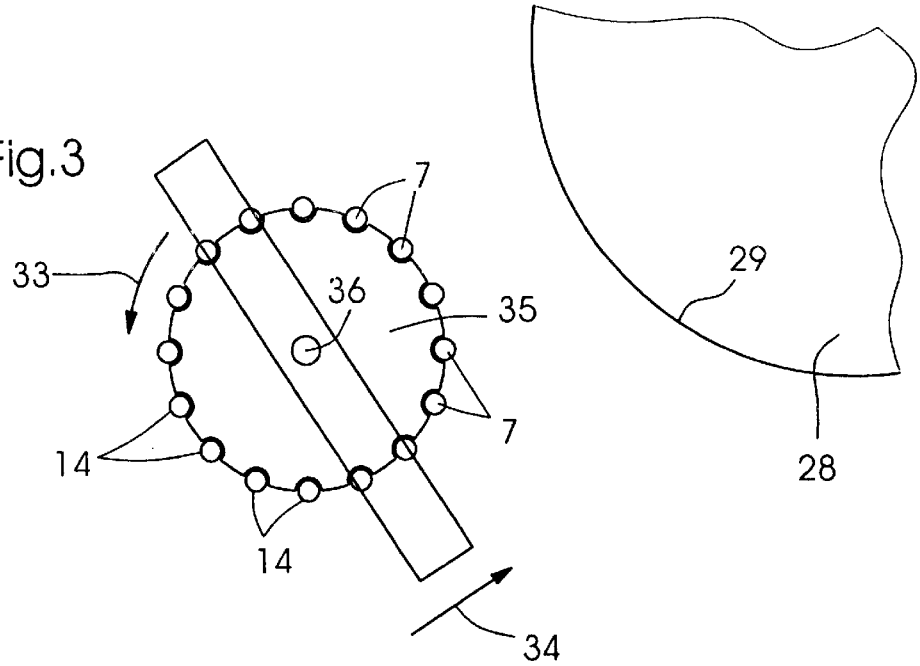
FIG. 3 is a fragmentary, elevational view illustrating guide and throw-on elements which are accommodated segment by segment on a rotatable carrier wheel and can be moved relative to one another.

The illustration according to FIG. 3 presents a further structural variant of the invention, with a rotating carrier element, which contains guide elements and throw-on elements for print carriers segment by segment.

A carrier wheel 35 can be rotated about a shaft 36 in a direction 33 and executes a throwing-on movement in the direction of an arrow 34 against a peripheral surface 29 of a form cylinder 28. Guide elements 7 and throw-on elements 14 are fitted segment by segment on the periphery of the carrier wheel 35. The guide elements 7 and the throw-on elements 14 are able to move relative to their mounting points on the periphery of the carrier wheel 35. The carrier wheel is mounted in such a way that it can rotate. If a print carrier is fitted to the peripheral surface 29 of the form cylinder 28, the carrier wheel 35 is set in a circumferential position in such a way that the guide elements 7 contact only the surface of the printing form of the print carrier to be fitted. However, during an unloading operation of a print carrier from a printing unit of a directly imaging rotary printing machine, the carrier wheel 35 is rotated and thrown against the peripheral surface 29 in such a way that the soiled surface of the print carrier to be removed makes contact with the throw-on elements 14 in a different segment of the carrier wheel 35. The guide elements 7 for feeding new print carriers to the surface 29 of the form cylinder 28 are disposed on the periphery of the carrier wheel 35 in such a way that they are offset by 180° from the throw-on elements 14 which make contact with a soiled form surface. The pressing movement in the throw-on or pressing direction 34 of the carrier wheel 35 is carried out only when feeding a new print carrier to the form cylinder 28 when the carrier has to be pressed against the peripheral surface 29. When a soiled print carrier is being removed from the printing unit of a directly imaging rotary printing machine, the pressing function of the carrier wheel 35 in the direction of the peripheral surface 29 of the form cylinder 28 is inactive.

Figure 4:
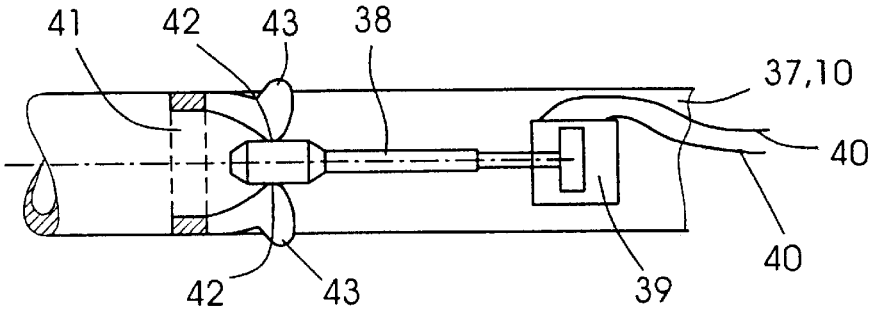
FIG. 4 is a fragmentary, partly-sectional view illustrating throw-on elements which can be actuated through the use of a pressure medium and extended from a roll surface.

FIG. 4 shows a further structural variant of the throw-on elements proposed according to the invention, which can be actuated with a pressure medium or in an electrical manner, by hand or with other operating elements, and are constructed as contact areas that can be extended from a roll surface.

The illustration according to FIG. 4 shows a roll body 37, 10, which can quite possibly also be configured as a tubular body according to the illustration in FIG. 1. Formed within the roll body 37 is an energy storage device in the form of a pressure chamber 39, into which a piston surface of a plunger 38 projects. The pressure chamber is connected through respective line connections 40 to a pressure source and a reservoir. Fluid can be applied through those connections to the pressure chamber 39. The piston of the plunger 38, projecting into the pressure chamber 39, effects a movement of the plunger in the horizontal direction. A contact area 42 provided on the plunger 38 makes contact with an inner surface of deformable throw-on elements 43. If the plunger, which is constructed with a thickened and a tapered area, moves into the contact area 42, then the throw-on elements 43 are widened to an extent which is governed by the dimensioning of the plunger 38. The outer peripheral surface of the throw-on elements 43 preferably projects beyond that of the annular guide elements 6 and 7 which are likewise fitted on the pressure roll 37, so that the guide elements are effectively protected against any deposition of ink and soiling of the printing form to be removed from the peripheral surface 29 of the form cylinder 28. A number of throw-on elements 43 constructed in accordance with FIG. 4 may be disposed over the axial extent of the pressure roll 37. The throw-on elements 43 can, for example, be accommodated at a distance from one another in an alternating sequence relative to a guide element 6 or 7 that is accommodated so as to be stationary.

Figure 5:
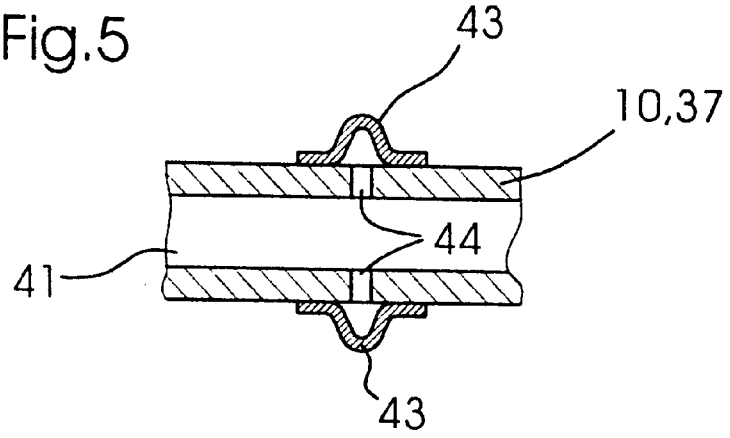
FIG. 5 is a fragmentary, sectional view illustrating throw-on surfaces to which pressure can be applied from an interior of a carrier body and which are connected through bores to a cavity within the carrier body.

FIG. 5 shows an illustration of throw-on elements to which pressure can be applied from an interior of a carrier body and which are connected to a cavity through openings in the peripheral surface of the carrier body.

The carrier body may be a tubular body 10 according to the illustration in FIG. 1.1 or a pressure roll 37 according to the illustration in FIG. 4. A number of openings 44 can be provided in the peripheral surface of the tube 10 or the roll 37. The openings 44 can open from the interior, to which a pressure medium can be applied, into cavities underneath deformable sections forming the throw-on elements 43. If a cavity 41 in the tube 10 or the pressure roll 37 has a pressurized fluid applied thereto, then the size of the throw-on elements 43 increases as viewed in the circumferential direction. This ability to be deformed is preferably provided in such a way that the outer periphery of the throw-on elements 43 projects beyond the outer periphery of the annular guide elements 6 and 7 that are fitted to the tube 10 or to the pressure roll 37 so as to be stationary, by an amount Ah which reliably prevents soiling.

Figure 6:
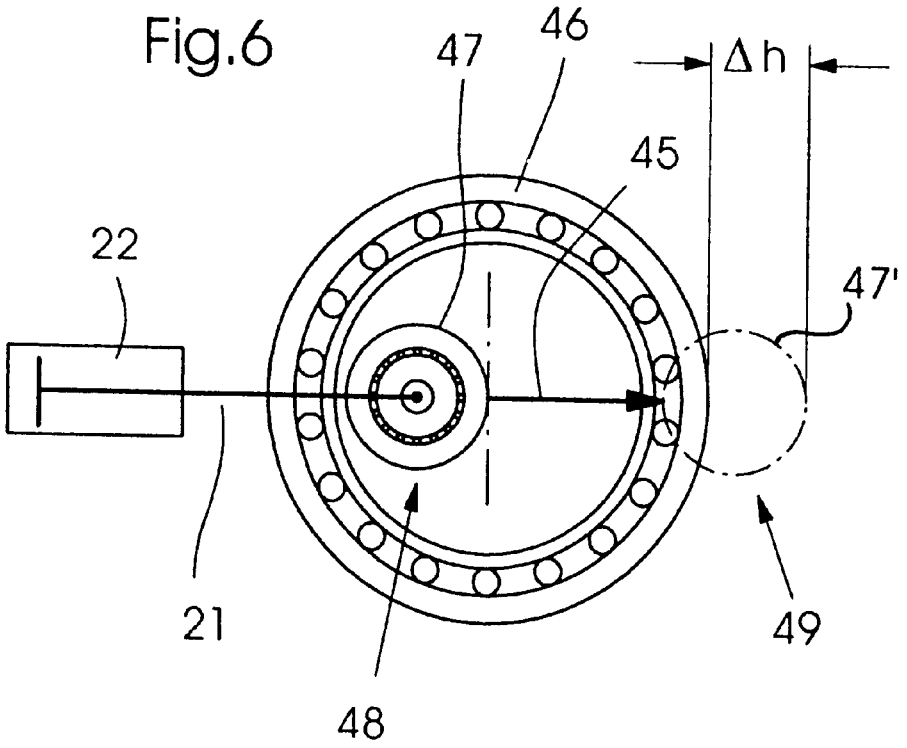
FIG. 6 is an elevational view illustrating guide and throw-on elements for print carriers, which lie in one plane and can be moved relative to one another by being actuated by actuating cylinders, according to a further structural variant of the concept according to the invention.

The illustration according to FIG. 6 shows a further structural variant of the solution proposed by the invention, in the shape of two guide or throw-on elements which are actuated by an actuating cylinder lying in one actuating plane.

In the illustration according to FIG. 6, a movable throw-on element 47 is moved in the direction of an arrow 45 by a diagrammatically illustrated piston/cylinder unit 21. The movement in the direction of the arrow 45 could also be brought about electrically, manually or with other operating elements. The arrow 45 designates the travel movement of the throw-on element 47 from a rest position indicated by reference numeral 47 into an activated position indicated by reference numeral 47'. The position 47 designates a first actuating position 48 of the throw-on element 47. In the position 47', which designates a second actuating position 49 of the throw-on element 47, the outer periphery of the throw-on element 47 projects beyond the periphery of a guide element 46 by the amount Δh. The amount Δh is preferably selected in such a way that soiling of the peripheral surfaces of the guide element 46 by the soiled surface of the printing form contacting the peripheral surface of the throw-on elements 47 is reliably prevented. The relative movement of the annular surfaces of the guide element 46 or the throw-on element 47 making contact with the surfaces of the print carrier during the feeding-in of a printing form or the unloading of a print carrier from the printing unit can, for example, be provided by diagrammatically illustrated cylinder roller bearings on annular carriers. The dimensioning can be preselected freely, irrespective of the size relationships illustrated in FIG. 6. The critical factor is a height difference Δh, established in the second position 49 of the throw-on element 47, between the peripheral surfaces of the guide element 46 for new printing forms and the peripheral surface 47 of the throw-on element which makes contact with the surfaces of printing forms of soiled print carriers to be removed.

Through the use of the guide elements 6, 30 and 46 described above in accordance with FIGS. 1 to 6, print carriers to be fed-in can be pressed against the surface 29 of form cylinders 28, which means that the function of pressing on the print carriers is added to the function of guiding the print carriers. Through the use of the throw-on elements having a position or shape or size which can be changed in the manner proposed by the invention, the contact area between the surface of a soiled print carrier to be removed from the printing unit of a rotary printing machine can be positioned in such a way that the guide elements 6, 7 which only feed-in and press on new print carriers are effectively protected against any contact with the soiled surface of the print carrier to be removed.

We claim:

1. In a rotary printing machine having a printing unit with a form cylinder, an apparatus for guiding a print carrier when feeding the print carrier to and guiding the print carrier away from the form cylinder, the apparatus comprising:

guide elements axially parallel to the form cylinder for assisting in feeding-in and pressing-on the print carrier, said guide elements disposed in two groups, one of said groups of guide elements serving to pull-in the print carrier and the other of said groups of guide elements serving to remove the print carrier from the printing unit, said guide elements having peripheral surfaces and an active range including a range of engagement with the print carrier;

throw-on elements for keeping said guide elements from making contact with the print carrier during exchanging of the print carrier, said throw-on elements having peripheral surfaces and being positioned in changeable pivotable relation to said guide elements outside the active range of said guide elements and pivotably removed from said range of engagement relative to the print carrier during feeding-in of the print carrier, said peripheral surfaces of said throw-on elements projecting beyond said peripheral surfaces of said guide elements by a distance in an extended position of said throw-on elements; and a base plate having at least one of coupling elements and coupling rods disposed thereon for articulatingly interconnecting said throw-on elements, said base plate rotatably receiving said guide elements.

2. The apparatus according to claim 1, including two fixed bearings, one of said guide elements fitted in an articulated manner between said fixed bearings, and an actuating cylinder for throwing said one guide element onto a peripheral surface of the form cylinder.

3. In a rotary printing machine, a printing unit, comprising:

a form cylinder; and an apparatus for guiding a print carrier when feeding the print carrier to and guiding the print carrier away from said form cylinder;

said apparatus having guide elements axially parallel to said form cylinder for assisting in feeding-in and pressing-on the print carrier, said guide elements disposed in two groups, one of said groups of guide elements serving to pull-in the print carrier and the other of said groups of guide elements serving to remove the print carrier from the printing unit, said guide elements having peripheral surfaces and an active range including a range of engagement with the print carrier;

said apparatus having throw-on elements for keeping said guide elements from making contact with the print carrier during exchanging of the print carrier, said throw-on elements having peripheral surfaces and being positioned in changeable pivotable relation to said guide elements outside the active range of said guide elements during feeding-in of the print carrier and pivotably removed from said range of engagement relative to the print carrier during feeding-in of the print carrier, said peripheral surfaces of said throw-on elements projecting beyond said peripheral surfaces of said guide elements by a distance in an extended position of said throw-on elements; and a base plate having at least one of coupling elements and coupling rods disposed thereon for articulatingly interconnecting said throw-on elements, said base plate rotatably receiving said guide elements.

* * * * *